United States Patent [19]

Kashiwagi et al.

[11] Patent Number: 4,959,550

[45] Date of Patent: Sep. 25, 1990

[54] AUTOMATIC EXCHANGER OF AN ELECTRON BEAM IRRADIATOR FOR WINDOW FOIL

[75] Inventors: Masayuki Kashiwagi; Takashi Matsumoto, both of Kyoto, Japan

[73] Assignee: Nissin High Voltage Co., Ltd., Kyoto, Japan

[21] Appl. No.: 194,913

[22] Filed: May 17, 1988

[30] Foreign Application Priority Data

May 18, 1987 [JP] Japan ..... 62-120372

[51] Int. Cl.[5] ..... H01J 33/04

[52] U.S. Cl. ..... 250/492.3; 250/503.1; 250/505.1; 250/492.1; 313/420

[58] Field of Search ..... 250/492.1, 492.3, 492.3, 250/503.1, 505.1; 313/420

[56] References Cited

U.S. PATENT DOCUMENTS

| | | | |
|---|---|---|---|
| 3,193,717 | 7/1965 | Nunan | 250/492.3 |
| 3,440,466 | 4/1969 | Colvin et al. | 250/492.3 |
| 3,499,141 | 3/1970 | Kingsley et al. | 250/492.3 |
| 4,112,307 | 9/1978 | Föll et al. | 250/492.3 |
| 4,286,166 | 8/1981 | Glukhikh et al. | 250/492.3 |
| 4,631,444 | 12/1986 | Cheever | 313/420 |
| 4,642,467 | 2/1987 | Yamawaki et al. | 250/492.3 |
| 4,734,586 | 3/1988 | Crist et al. | 250/492.3 |
| 4,785,254 | 11/1988 | Cruz et al. | 313/420 |
| 4,829,190 | 5/1989 | Okamoto et al. | 250/492.3 |

OTHER PUBLICATIONS

"A Vacuum-to-Air Interface for the Advanced Test Accelerator Director", Cruz et al., *Lawrence Livermore National Lab,* UCRL-94686—Preprint, Jun. 27, 1986.

*Primary Examiner*—Janice A. Howell
*Assistant Examiner*—Kiet T. Nguyen
*Attorney, Agent, or Firm*—Finnegan, Henderson, Farabow, Garrett, and Dunner

[57] ABSTRACT

A roller-type automatic foil exchanger for supplying a foil beneath a window in a flange of a surface of a vacuum container of an electron beam irradiator includes a foil feed roller having foil wound thereon and a foil take-up reel for winding foil thereon. The foil is supported on a foil holder beneath the window and between the flange and the foil holder. A winding motor rotates the take-up reel to wind foil thereon and to unwind foil from the foil feed roller. A plurality of clamper members are provided to clamp the foil holder to the flange with the foil therebetween.

5 Claims, 2 Drawing Sheets

AUTOMATIC EXCHANGER OF AN ELECTRON BEAM IRRADIATOR FOR WINDOW FOIL

FIELD OF THE INVENTION

The present invention relates to a roller-type automatic exchanger for a window foil of an electron beam irradiator.

BACKGROUND OF THE INVENTION

In an electron beam irradiator, an electron beam is generated and accelerated in a high-degree vacuum and is emitted into the atmosphere to irradiate an object with electrons and to cause a chemical reaction therein to change the chemical properties thereof. Although the electron beam irradiator is used for various purposes, it is most often used for polymerization in applications to cross-link an electric insulator that coats an electric wire, a heat-shrinkable tube, formed polyethylene, a rubber tire and so forth. The electron beam irradiator can be used to sterilize medical equipment, process foodstuffs and feedstuffs, denitrate and desulfurize smoke, and harden a liquid resin for coating, printing, lamination, magnetic medium processing, and so forth. The amount of energy of the electron beam is expressed by the acceleration voltage, which is commonly about 100 kV to 10,000 kV, and differs depending on the purpose of the irradiation by the electron beam. The amount of energy of the electron beam is sometimes classified into a low range for 300 kV or less and a medium and high range of more than 300 kV. Since an electron beam in the low range of energy only reaches the surface of the object and the vicinity thereof, the beam is used for surface processing. For example, an electron beam in the low range is used to harden a liquid resin for coating, printing, lamination, magnetic medium processing, integrated circuit board processing, and so forth. Therefore, the electron beam irradiator is not a measuring apparatus.

A large number of measuring devices employing electron beams have already been provided. The measuring devices include an electron microscope, a reflection-type high-energy electron beam diffraction device, a low-energy electron beam diffraction device, and so forth. In each of the measuring devices, an object is put in a high-degree vacuum and the device is required to measure the distribution of angles of scattered electrons from the object and the angles of diffraction electrons therein.

The electron beam irradiator is a processing apparatus that irradiates electrons upon the object to cause a chemical change therein to alter the quality thereof. Therefore, the electron beam irradiator is different from a measuring device that uses the electron beams and measures the intensity distributions of scattered electrons, secondary electrons, diffracted electrons, and so forth.

An electron beam irradiator typically comprises a high DC voltage power supply, an electron gun, an accelerating tube, a scanning horn, an irradiation window, an object conveyor, and a vacuum degassing unit. The high DC voltage power supply is for generating a high voltage necessary to accelerate the electrons, and is made of a Cockcroft-Walton circuit, Delon-Grainahel circuit, Dinamitron DC power supply, or the like. If the current from the high DC power supply is as weak as 1 micro-amp to 1 milli-amp, a van de Graff type supply may be used.

In the electron gun, electricity is applied to a filament in a vacuum to emit thermoelectrons and attract the thermoelectrons toward an anode to separate the thermoelectrons. In the accelerating tube, annular electrodes are juxtaposed and negative voltages are distributed thereto in the direction of the flow of the electrons to vertically accelerate them downward. In the scanning horn, the electrons vertically proceeding downward are subjected to magnetic fields in two directions to cause the electrons to perform scanning motions in two directions.

If the energy of the electron beam in the electron beam irradiator is in the low range, the irradiator may not have the scanning horn. Since an electron beam of very high speed is curved by the scanning horn, the horn needs to have a long proceeding distance for the electron beam. For that reason, if the electron beam irradiator has a scanning horn, the irradiator will be bulky. Since it is difficult to use practically a non-scanning-type electron beam irradiator whose electron beam is in the medium and high range of energy, an electron beam irradiator having an electron beam is in the medium and high range of energy is usually of the scanning type. FIG. 3 shows a schematic view of an electron beam irradiator with a scanning horn.

Since an electron beam irradiator whose electron beam is in the low range of energy is required to be compact, the irradiator is not provided with a scanning horn and is of the non-scanning-type, which is sometimes also called the area type. In such a low energy irradiator, the length of the accelerating tube can also be made small, and the electron beam can be accelerated in some cases by using only a pair of electrodes. Therefore, the accelerating tube can be made compact.

The interior opening of each of the electron gun, accelerating tube, and scanning horn (which is not provided in some electron beam irradiators) of the electron beam irradiator shown in FIG. 3 are all subject to a high-degree vacuum. A vacuum degassing unit degases the interior opening of each of them to the high-degree vacuum. The irradiation window forms a border between the vacuum and the atmosphere. The interior opening of each of the accelerating tube and the scanning horn is in high-degree vacuum, while the object is placed in the atmosphere. Therefore, the accelerating tube and the scanning horn constitute a vacuum container.

If the scanning horn is provided in the electron beam irradiator, the bottom of the scanning horn has the irradiation window. If the scanning horn is not provided in the electron beam irradiator, the bottom of the accelerator would have the irradiation window. In either case, the irradiation window is formed in the electron beam opening from the vacuum container.

The irradiation window is made of a material that blocks air to maintain the high-degree vacuum but allows the electron beam to pass. Since the electron beam comprises radiation of low penetration power, the thickness of the material must be very small. For that reason, a titanium foil of about 15 to 30 microns in thickness or an aluminum foil of about 30 to 70 microns in thickness is used as the material. The difference between the pressure on the inside of the material and that on the outside is nearly equal to atmospheric pressure because the interior opening of the vacuum container constituted by the accelerating tube and the scanning horn is in the high-degree vacuum and the object is in the atmosphere.

If the irradiation window is of small thickness it will be be deformed into the high-degree vacuum and will be subject to a high degree of tension if the area of the irradiation window is large. The thickness of the material should be made large in order to enable the material to withstand strong tension. If the thickness of the material is large, however, much of the electron beam will be absorbed and a large energy loss will occur. Even if the thickness of the material is small, the electron beam loses some of its energy because each of the electrons is a charged particle of small mass. A thin and durable titanium foil is often used as the material for covering the irradiation window.

An object conveyor carries an object from an inlet port to a position directly beneath the irradiation window, and thereafter carries the processed object to an outlet port. A conveyance mechanism is provided in the base of the conveyor through which X-rays cannot pass. Inlet and outlet port preparation chambers, which are closed by shutters, are provided at the ends of the conveyor. Since X-rays are emitted when the electron beam collides against a substance, it is necessary to block the X-rays.

In the conventional device for holding the foil for the irradiation window it has been particularly troublesome to replace the foil. Since a pressure difference nearly equal to 1 atmosphere acts against the thin foil 3, the foil is subject to a tension force equal to the product of the pressure difference and the area of the foil. When the electron beam passes through the foil 3, much of the energy of the beam is absorbed to generate heat that raises the temperature of the foil. Although cooling air is blown against the bottom (exterior) surface of the foil 3 to cool it, the beam passage area thereof is heated to a high temperature. In other words, the foil 3 is subject to high tension as a result of the pressure differential and also to heat, which fatigues the foil. For that reason, the foil 3 must be replaced every several months. If during the process the foil 3 is broken, the accelerating tube of the electron beam irradiator will no longer be subject to high vacuum and the electrodes of the accelerating tube are likely to be damaged. Therefore, it is necessary to replace the foil 3 without breaking it.

In order to replace the foil 3, a person must enter the irradiation chamber, remove the many bolts 8 (the number of which may be as high as a hundred), remove the old foil and attach a new one to the foil holder 2 by a tape. At that time, it is necessary to attach the new foil under tension to keep the new foil tight. This is difficult work. The foil holder 2 fitted with the new foil is lifted to the flange 11 and coupled thereto by the bolts 8. The foil holder 2 is so heavy that it is very hard for only one person to lift it. Therefore, at least two persons are needed to lift the foil holder 2. It is then necessary to tighten the many bolts 8 again. Therefore, the replacement of the foil 3 is very laborious work and takes much time. For example, it is common to use three persons for 4 to 5 hours each to replace the foil in a conventional unit.

It is required that the force that couples the foil holder 2 to the flange 11 be uniformly applied. If the force is not uniform, the surfaces will not be parallel and a gap will be present at the edge of the foil 3 causing the tension or the foil to be locally increased. For that reason, the tightening torque for each of the bolts 8 must be controlled carefully to be a prescribed level so that the force that couples the foil holder 2 and the flange 11 to each other acts uniformly. It is laborious to control the tightening torque to the required degree on all the bolts 8. Moreover, since such work must be done by the persons in the irradiation chamber, the work can be dangerous. If a plurality of electron beam irradiators are installed in the same irradiation chamber, the operation of all of the irradiators must be stopped when the foil of one is being replaced because ozone or X-rays should be prevented from being generated. Even if the operation of all the electron beam irradiators is stopped, it is still dangerous to enter the irradiation chamber because the chamber will be full of ozone.

SUMMARY OF THE INVENTION

An object of the present invention is a window foil exchanger capable of exchanging the window foil of an electron beam irradiator in a short time without requiring a person to enter an irradiation chamber.

Another object of the present invention is an improved apparatus for changing the foil in an electron beam irradiator.

These and other objects are accomplished by a roller-type automatic foil exchanger for supplying a foil beneath a window formed in a flange at a surface of a vacuum container in an electron beam irradiator comprising a foil feed roller provided at one end of the flange and connected to one end of the foil, the feed roller for providing the foil, a foil take-up roller provided at the opposite end of the flange with respect to the foil feed roller and connected to the other end of the foil, a foil holder for supporting the foil such that the foil is between the flange and the foil holder, a winding motor for rotating the foil take-up roller to wind the foil thereon and to cause foil to be unwound from the foil feed roller, and a plurality of clamper means selectively actuatable to clamp the foil holder to the flange with the foil therebetween.

BRIEF DESCRIPTION OF THE DRAWINGS

The manner by which the above objects, and other objects, features, and advantages of the present invention are accomplished will be apparent from the following detailed description when it is considered in view of the drawings, wherein.

DETAILED DESCRIPTION

In the window foil exchanger provided in accordance with the present invention, a foil holder and a flange are not secured to each other by bolts but by clampers which make it possible to automatically attach and detach the foil holder and the flange to and from each other. In addition, oblong window foils are not used for replacement. Instead, foil is supplied on a roller and is fed in appropriate lengths between the foil holder and the flange.

Figure 1:
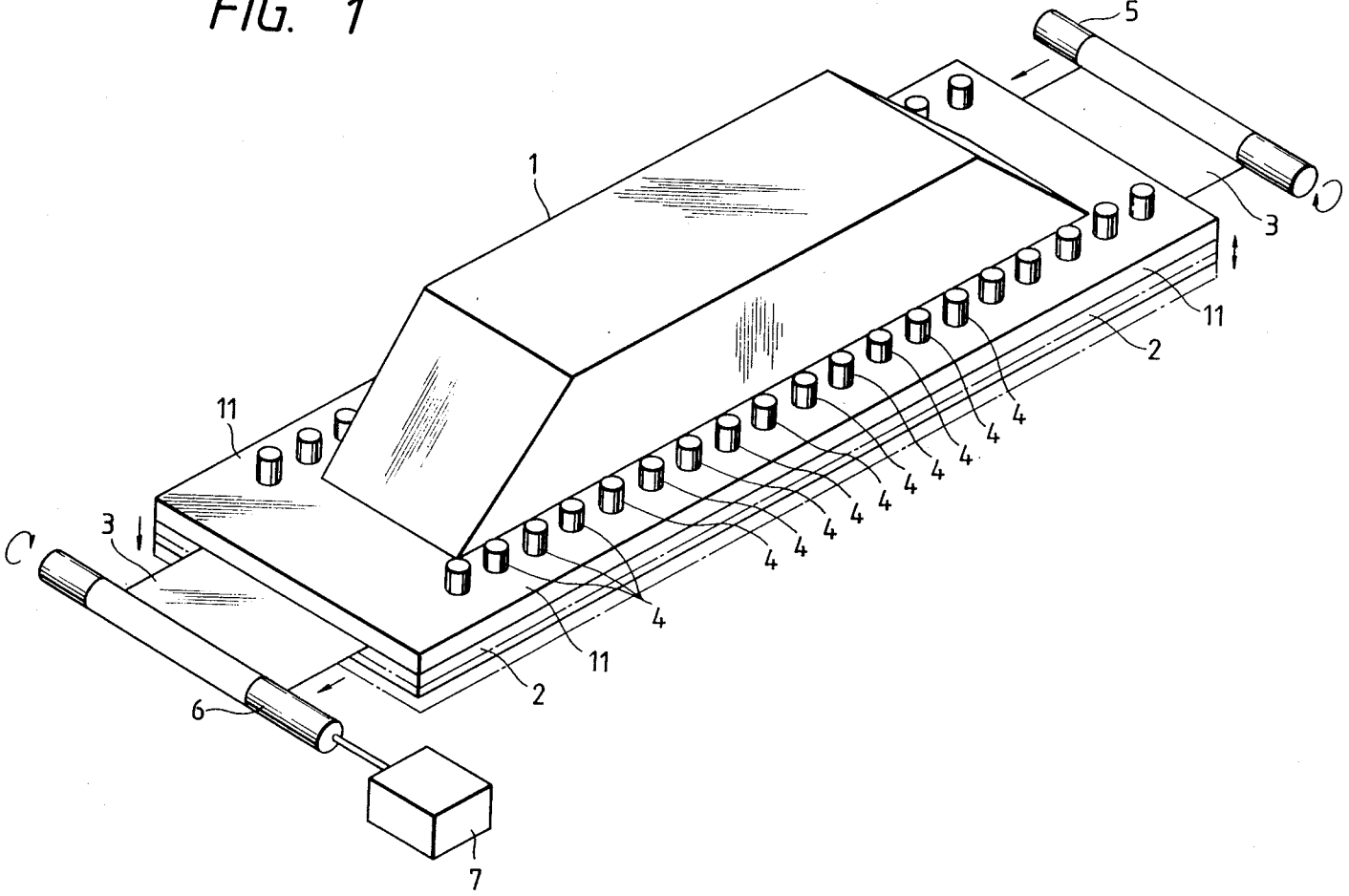
FIG. 1 shows a perspective view of a roller-type automatic foil exchanger according to the present invention.
Figure 2:
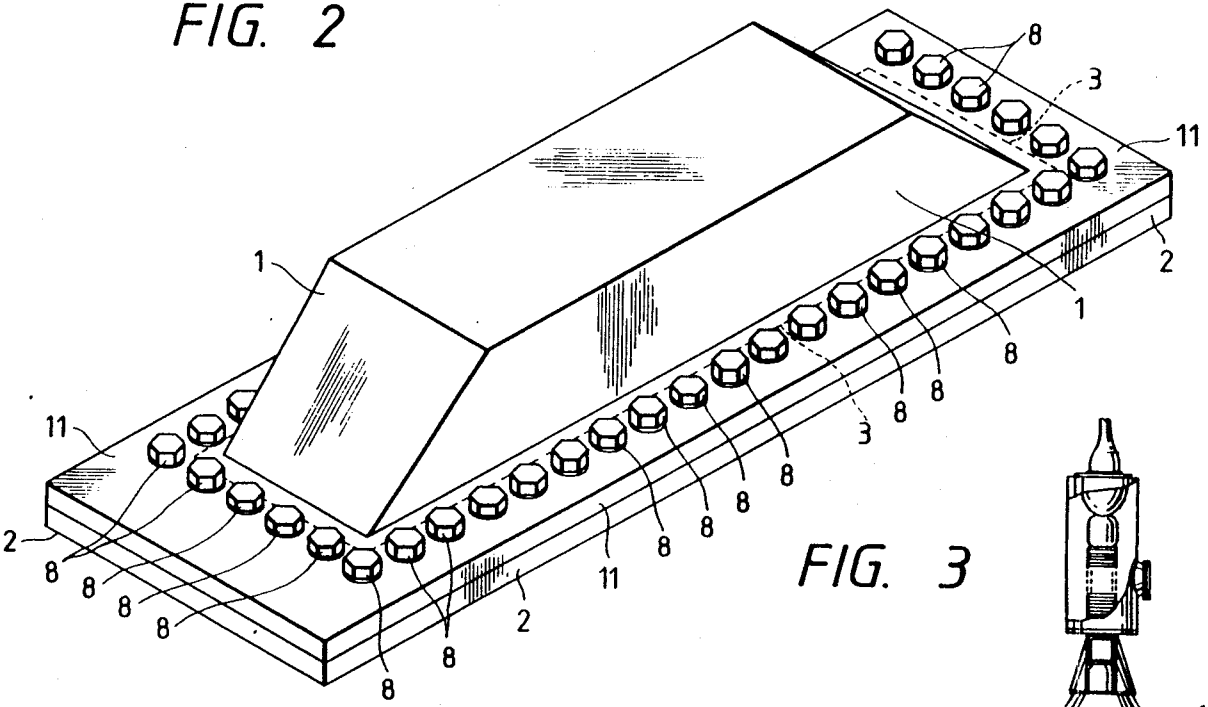
FIG. 2 shows a perspective view of a conventional device for holding a foil in an electron beam irradiator.
Figure 3:
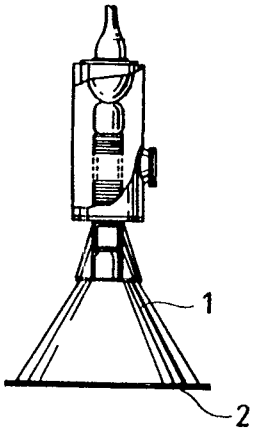
FIG. 3 shows a schematic view of an electron beam irradiator of the scanning type.

An embodiment of an automatic foil exchanger for the irradiation window of a scanning type electron beam irradiator of the scanning type is hereafter described with reference to FIG. 1. The irradiation window is provided in the lower portion of a scanning horn 1 constituting a part of a vacuum container. The longitudinal section of the scanning horn 1 is shaped as an isosceles trapezoid so that the scanning horn has a front wall, a rear wall, and oblique side walls. The cross section of the scanning horn 1 is slender.

In the scanning horn 1, an electron beam accelerated by an accelerating tube is deflected in the longitudinal direction of the cross section of the scanning horn and the direction perpendicular to that longitudinal direction. The deflection of the electron beam is caused by applying alternating currents to electromagnets opposed to each other in the two horizontal directions. The electron beam is usually caused to perform a scanning motion along rectangular loci.

An object is conveyed in a space (in the atmosphere) beneath the scanning horn 1, and perpendicularly to the longitudinal direction of the horn. For example, the length of a flange 11 on the scanning horn 1 and the width of the flange, which is perpendicular to the length, may be 1,600 mm and 500 mm, respectively. A large number of vertically movable clampers 4 are provided along the length of the flange 11 provided at the irradiation window in the lower portion of the scanning horn 1. The tips of the movable rods of the clampers 4 are secured to a foil holder 2. For example, the clampers 4 are made of hydraulic or pneumatic cylinders. Although a large number of clampers 4 are provided along the length of the flange 11, no clamper is provided along the width thereof, because a window foil 3, which is long like a tape, is moved in the longitudinal direction of the flange 11.

The window foil 3 is not cut to provide a sheet to be used for the irradiation window of the electron beam irradiator. Instead, a length of the tape-like foil 3 sufficient for a number of replacements of the irradiation foil is wound on a feed roller 5. The tape-like foil 3 is fed from the feed roller 5 to a winding roller 6 and passes through the irradiator between the flange 11 and the foil holder 2. A winding motor 7 is connected to the winding roller 6 to rotate the roller 6 and wind the foil 3 thereon. The feed roller 5 and the winding roller 6 are supported by appropriate rotary shafts and bearings which are not shown in FIG. 1.

The foil 3 is supported along an oblong perimeter by the flange 11 and the foil holder 2. The surfaces of the flange 11 and the foil holder 2, which are brought into contact with the window foil 3, are provided with O-rings or other seals (not shown in FIG. 1) along the edges thereof. Since the window foil 3 is held on both sides by the O-rings or other seals such that no gaps are formed, a vacuum may be maintained in the vacuum container.

When the running of the electron beam irradiator is continued for a period of time, the portion of the window foil 3, which is held by the flange 11 and the foil holder 2, deteriorates due to heat and pressure. Since the portion of the foil 3 in the irradiator window must not be broken, the portion is periodically changed as follows. For the exchange, the generation of the electron beam is stopped, no voltage is applied to the accelerating tube, and the interior openings of the scanning horn 1 and the accelerating tube are filled with air at atmospheric pressure. The foil holder 2 is moved away from the flange 11. The winding motor 7 is started to rotate the winding roller 6 to wind thereon a predetermined length of foil corresponding to the length of the irradiation window. The feed roller 5 exerts a resistive force to subject the window foil 3 to tension along the length thereof so that the window foil does not loosen in the longitudinal direction. The winding roller 6 is stopped so that a new portion of the foil 3 is located under the flange 11 and in front of the irradiation window. The clampers 4 are then operated to pull the foil holder 2 up to strongly press the foil 3 between the flange 11 and the foil holder 2 and deform the O-rings or other seals. No gap exists between the window foil 3 and the flange 11 and between the window foil 3 and the foil holder 2, so that a vacuum may be maintained in the scanning horn 1. The changing of the foil does not require a person to enter into the irradiation chamber, and can be accomplished automatically in a short time.

The present invention eliminates the need to loosen scores of bolts and then to re-attach and tighten the bolts. This changing of the foil is made simple and may be finished in a short time.

By using the present invention, one person can change the foil in about 10 minutes simply by operating buttons of a control panel. It is no longer necessary for the person to enter the irradiation chamber or to be subjected to X-rays and ozone. Even if a plurality of electron beam irradiators are installed in one irradiation chamber, it is not necessary to stop the running of all the electron beam irradiators when the foil of one of them is being changed.

What is claimed is:

1. A roller-type automatic foil exchanger for supplying a foil beneath a window formed in a flange at a surface of a vacuum container in an electron beam irradiator comprising:

a foil feed roller provided at one end of the flange and connected to one end of the foil, said feed roller for providing the foil;

a foil take-up roller provided at the opposite end of the flange with respect to said foil feed roller and connected to the other end of the foil;

a foil holder for supporting the foil such that the foil is between the flange and the foil holder;

a winding motor for rotating said foil take-up roller to wind the foil thereon and to cause foil to be unwound from said foil feed roller; and a plurality of clamper members having portions extending through said flange and said foil holder, said clamper members being selectively actuatable to clamp said foil holder to the flange with the foil therebetween, said clamper members being disposed on either side of the foil along lines substantially parallel to the rolling direction of the foil.

2. A roller-type automatic foil exchanger according to claim 1, wherein the foil is a tape-like member.

3. A roller-type automatic foil exchanger according to claim 1, wherein said foil is made from titanium.

4. A roller type automatic foil exchanger as recited in claim 1, wherein said clamper members each includes a hydraulic cylinder.

5. A roller type automatic foil exchanger as recited in claim 1, wherein said clamper members each includes a pneumatic cylinder.

* * * * *